United States Patent [19]

Pettican

[11] 4,252,304

[45] Feb. 24, 1981

[54] WORKBENCH

[75] Inventor: Charles W. Pettican, Wokingham, England

[73] Assignee: Black & Decker Inc., Newark, Del.

[21] Appl. No.: 3,067

[22] Filed: Jan. 12, 1979

[30] Foreign Application Priority Data

Jan. 12, 1978 [GB] United Kingdom ..... 1261/78

[51] Int. Cl.[3] ..... B25B 1/22

[52] U.S. Cl. ..... 269/139; 269/152; 269/154; 269/155; 269/220; 269/901; 269/283

[58] Field of Search ..... 269/104, 110, 152, 154, 269/155, 139, 219, 220, 321 CF, 283

[56] References Cited

U.S. PATENT DOCUMENTS

| | | | |
|---|---|---|---|
| 1,453,018 | 4/1923 | McHewitt et al. | 269/153 |
| 2,322,380 | 6/1943 | Mosley | 269/152 |
| 3,880,416 | 4/1975 | Horwitz | 269/152 |
| 4,061,323 | 12/1977 | Beekerkamp | 269/139 |

*Primary Examiner*—Robert C. Watson

*Attorney, Agent, or Firm*—Leonard Bloom; Edward D. Murphy; Walter Ottesen

[57] ABSTRACT

A workbench includes a top structure and a supporting structure for supporting the top structure above the floor. The top structure includes a three part vice, one part being a first elongate vice member and the second and third parts together forming a second elongate vice member extending in side-by-side relationship with the first elongate vice member, the two elongate vice members having opposed clamping faces. A first vice operating arrangement causes movement of the clamping face of at least one vice member towards and away from the clamping face of the other vice member. A second vice operating arrangement causes relative movement of the second and third parts in a direction parallel to the direction of elongation of the vice members to permit clamping of objects between opposed further clamping faces of the second and third parts.

16 Claims, 6 Drawing Figures

WORKBENCH

BACKGROUND OF THE INVENTION

Workbenches are known which incorporated a top structure comprising a giant vice, for example forming the subject of British Pat. No. 1,267,032 corresponding to U.S. Pat. Nos. 3,615,087 and 3,841,619. Such giant vices comprise a pair of elongate vice beams forming the complete work surface of the workbence and which can be shifted relatively to one another in the manner of a vice by means of a pair of independently operable vice operating screws. This construction is capable of clamping up many different objects of different shapes and sizes both within the clamping gap between the vice members and by means of a number of plug-in abutments received in vertical bores in the vice members.

SUMMARY OF THE INVENTION

It is an object of this invention to provide a workbench even more versatile than the workbenches described above capable of clamping even further objects.

This object is realized according to the workbench of the invention which includes a top structure and a supporting structure for supporting the top structure above the floor, the top structure comprising a three part vice, one part comprising a first elongate vice member and the second and third parts together forming a second elongate vice member extending in side by side relationship with the first elongate vice member, the two elongate vice members having opposed clamping faces, first vice operating means being included for causing movement of the clamping face of at least one vice member towards and away from the clamping face of the other vice member and second vice operating means being included for causing relative movement of the second and third parts in a direction parallel to the direction of elongation of the vice members to permit clamping of objects between opposed further clamping faces of the second and third parts.

The top structure may include a pair of transverse supports on which the first elongate vice member is supported for movement towards and away from the second vice member, and the top structure may include a front support extending between the front ends of the transverse supports and rigidly connected thereto, the front support at least partially carrying one or both of the second and third parts.

Preferably the first vice member is mounted for sliding movement on the transverse supports under the control of the first vice operating means and this latter means may comprise a pair of spaced vice operating screw threads each carrying a nut which is connected to the first vice member by a single vertical pivotal connection enabling independent operation of the two vice operating screws, and, when desired, the production of a tapered gap between the first and second vice operating members.

In contrast the second vice operating means is arranged to cause linear relative movement of the second and third vice parts. The second part may be fixed rigidly to one of the transverse supports and is supported partially by the said transverse support and partly by the front support. The third vice part is mounted for sliding movement on the front support. For example, the third vice part may be connected for sliding movement with respect to the front support by means of vertical bolts passing through the third vice part and through slots in the front support.

Desirably the three parts are separated from the remainder of the top structure by spacer blocks. For example, in the case of the first vice member, the spacer blocks may comprise one at each end and disposed between the first vice member and the transverse supports. The spacer block in the case of the fixed second vice part may comprise a T shaped block and a pair of spacer blocks may be disposed between the third vice part and the front support. Conveniently the second vice operating means extends through the spacer block separating the second vice part from the transverse support. The second vice operating means therefore extends below the second and third parts and includes a nut connected by a rigid vertical connection to the underside of the third part.

Desirably the first vice operating means is situated at a level below the level of the second vice operating means in order not to interfere therewith. Thus the second vice operating means may lie above a plane defined by the upper surfaces of the transverse supports and the front support, whilst the first vice operating means may comprise a pair of screw threaded rods each extending beneath the said plane.

BRIEF DESCRIPTION OF THE DRAWING

The invention may be carried into practice in a number of ways but one specific embodiment will now be described by way of example with reference to the accompanying drawings, in which.

DESCRIPTION OF THE PREFERRED EMBODIMENTS OF THE INVENTION

Figure 1:
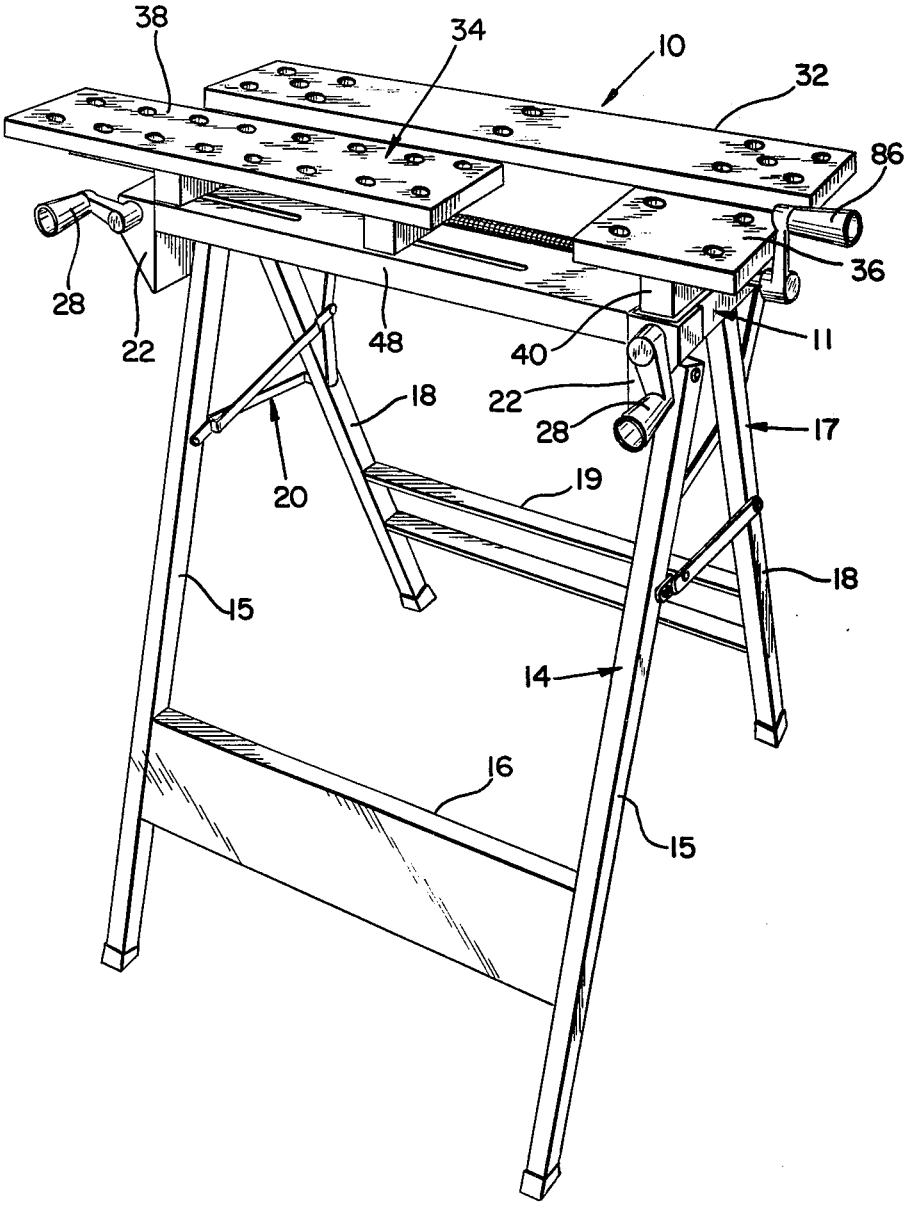
FIG. 1 is a perspective view of a workbench according to the present invention.

The bench shown in the drawings and in particular in FIG. 1 includes a top structure generally indicated at 10 which will be described in detail. The top structure includes a pair of transverse supports generally indicated at 11, these supports each being of generally inverted U channel section as shown clearly in FIG. 2, the legs of the U being of different length. The longer legs 12, which oppose one another, have pivoted to them front and rear supporting frames of an infrastructure. The front frame 14 includes a pair of sloping legs 15 interconnected by a transverse pressing 16. The rear frame 17 is also formed by a pair of legs 18 again interconnected by a rear pressing 19.

On each side the leg 15 and the leg 18 together with the associated transverse support 11 are braced by means of a multipart linkage generally indicated at 20.

Figure 3:
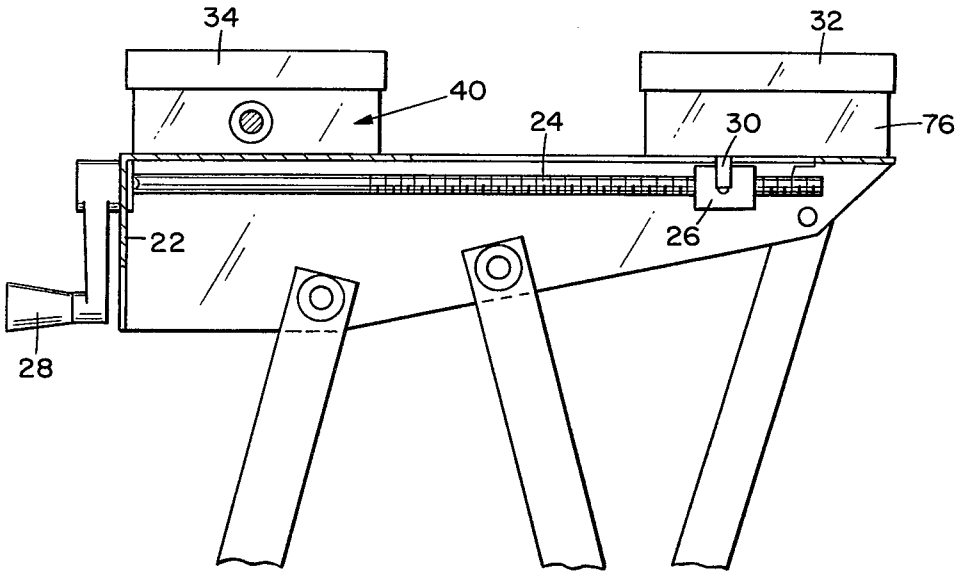
FIG. 3 is a sectional end elevation of the bench of FIGS. 1 and 2.

As indicated in FIGS. 1 and 3, the limbs of the U shape supports 11 are interconnected at their front ends by front walls 32 and journalled in these front walls are a pair of vice operating screw-threaded rods 24 which extend from front to back or transversely of the bench within the respective channel formed by the transverse supports 11. The rear ends of the screw 24 are not journalled, but the screws carry slider members or nuts 26, which, as the rods 24 are rotated by handles 28, are moved forward and backwards. Secured to the nuts 26, by means of vertical pivotal connections 30 is a movable rear vice beam 32 forming part of the top structure 10 and having a forwardly facing planar clamping face. The manner of operation of the movable vice member 32 by means of the two rods 24 is the subject of British Pat. No. 1,267,032. By independent operation of the vice handles 28 one nut 26 can be moved to a greater or lesser extent that the other in order to position the vice beam 32 at an angle to a front beam 34. Moreover this mode of operation enables one handle 28 to be operated to a considerable extent independently of the other handle 28 for convenient clamping of objects in the vice formed by the beams 32 and 34.

Figure 2:
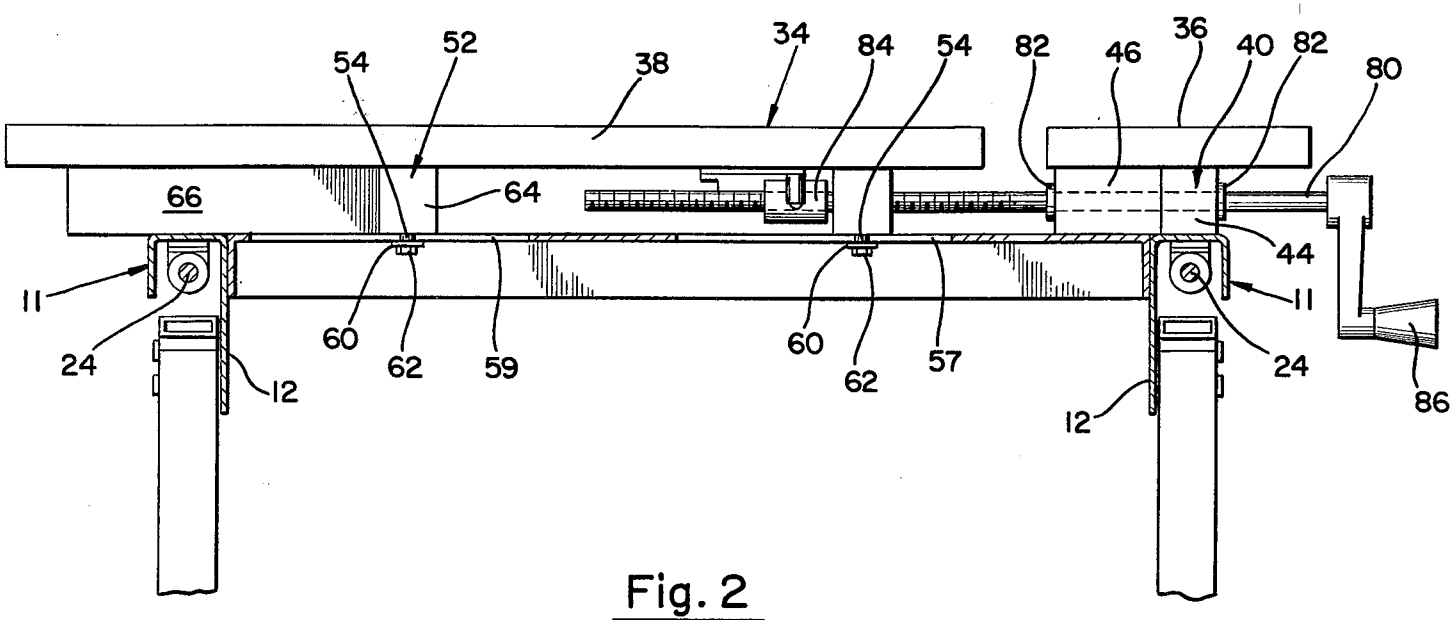
FIG. 2 is a front view, partly in section, of the upper end of the bench of FIG. 1.
Figure 4:
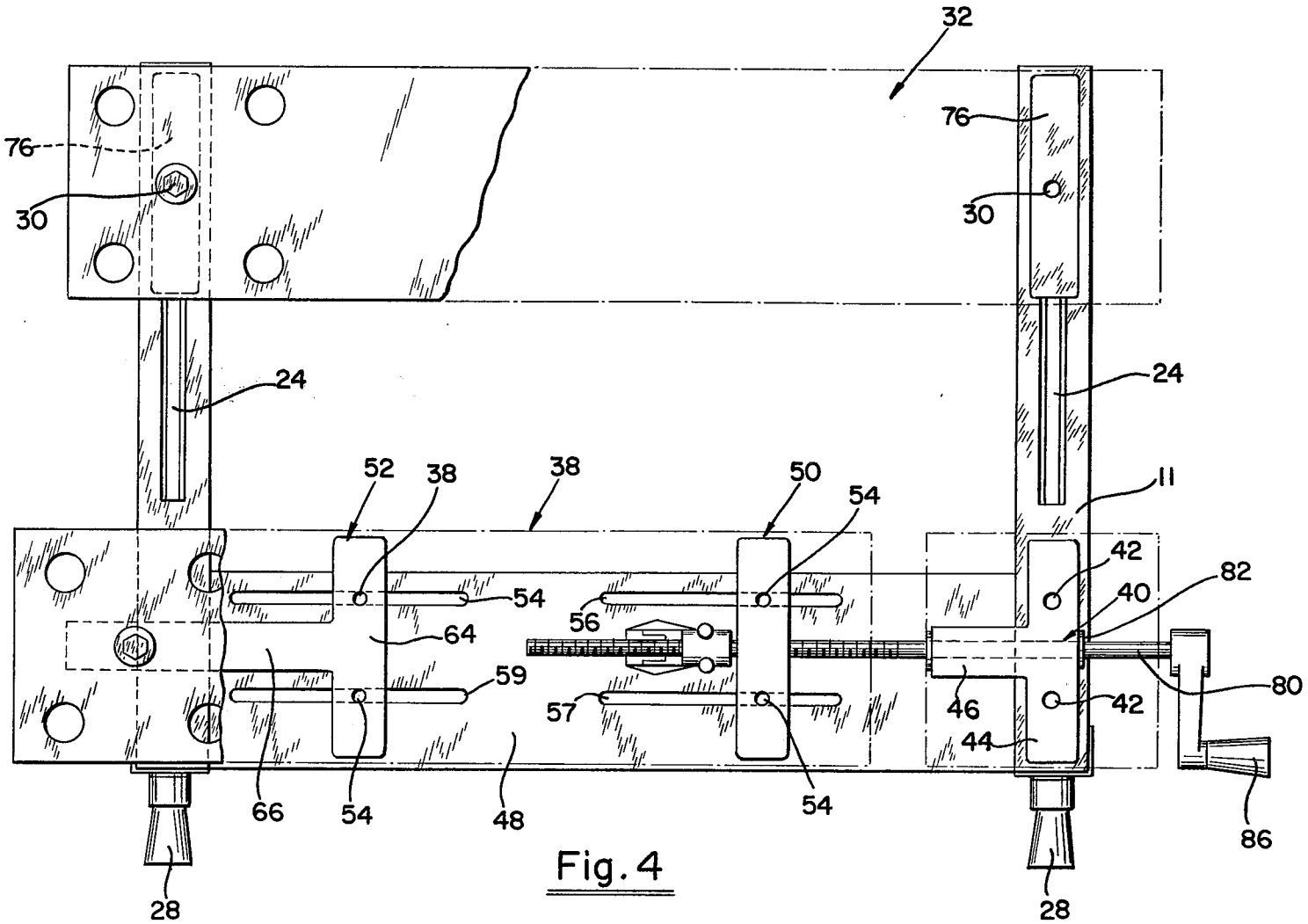
FIG. 4 is a plan view with certain parts broken away to show detail underneath.

As indicated in FIGS. 1 and 2, the front beam 34 is formed in two sections, namely, a stationary short section 36 and a movable longer section 38. The short vice beam section 36 is supported on the right hand transverse support 11 by means of a T shaped spacer 40 the shape of which in plan is shown in FIG. 4. The stationary short vice beam section 36 and the spacer 40 are secured rigidly to the transverse support 11 by means of a pair of vertically extending bolts 42. The spacer 40 includes a head piece 44 extending parallel to the transverse support 11 and a stem piece 46 extending at right angles thereto.

Extending between the front ends of the transverse supports 11 is a front support generally indicated at 48. The front support 48 is secured to the transverse supports 11 by means of bolts (not shown) which permit ready assembly of the whole workbench.

The longer movable vice beam section 38 of the front vice beam 34 is supported for sliding movement on top of the front support 48 by means of a pair of spacer blocks 50 and 52 which are each secured to the vice beam section 38 by a pair of vertically extending bolts 54. These bolts extend through longitudinal slots 56, 57, 58 and 59 formed in the top of the front support 48, and carry at their lower ends washers 60 and nuts 62. The spacer block 52 is of T shape as shown in FIG. 4 and includes a head portion 64 extending transversely of the longer movable vice beam section 38 whilst a stem portion 66 of the spacer block 52 extends lengthwise of this vice beam section. In this way the vice beam section 38 is rigidly supported by the front support 48 and hammer blows can be transferred through the spacer blocks to the front support 48 and thence via the transverse supports 11 to the lower leg structure.

Figure 5:
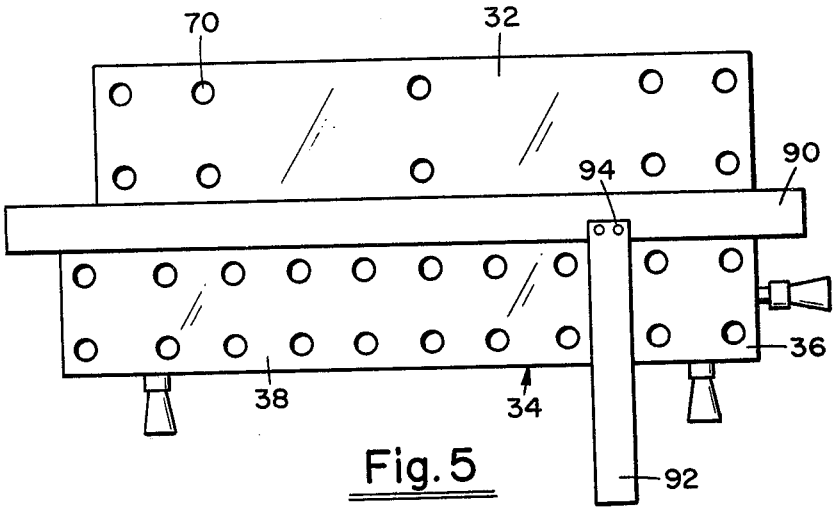
FIG. 5 is a plan view showing one mode of operation of the workbench of FIGS. 1 to 4.
Figure 6:
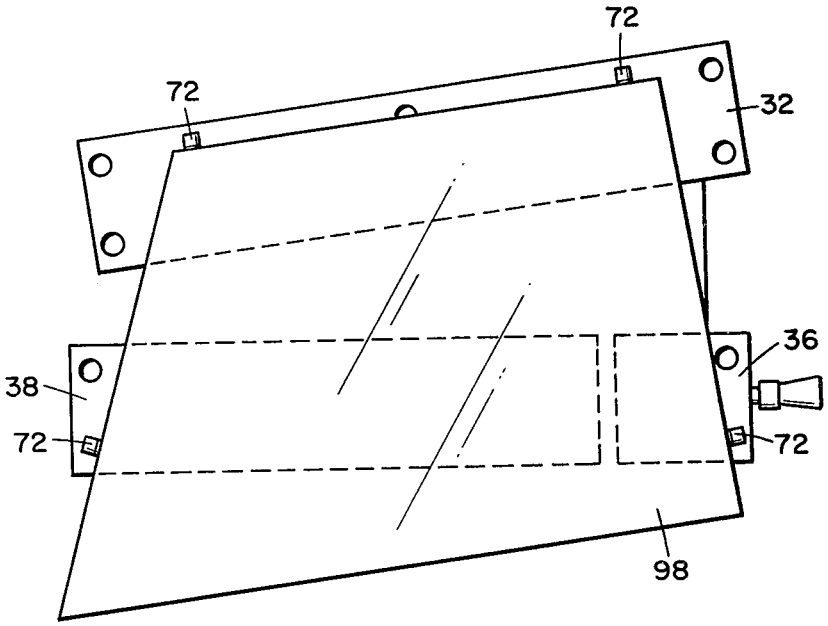
FIG. 6 is a further plan view showing an alternative work mode.

The rear vice beam 32, as shown in FIG. 5, has in it a number of vertically extending bores 70 each of which can receive a plug-in abutment 72 as shown in FIG. 6 and of the form described and claimed in British Pat. No. 1,422,521. Thus each of the plug-in abutments can rotate about a vertical axis extending through the bore 70 in order to align with a workpiece to be clamped by the abutment 72.

The number of bores 70 in the movable vice beam 32 is restricted so as not to weaken it in view of the fact that there is no support in the central region of the vice beam 32 between the two spacer blocks 76 by which it is supported on the transverse supports 11.

In contrast the two sections of the front vice beam 34 have rows of equally spaced holes throughout their length again to receive abutments 72. It is possible to weaken the vice beam section 38 to this extent, i.e., more so than the movable vice member 32, by virtue of the spacer blocks 50 and 52 providing closely supported regions of the vice beam section 38.

The vice beam section 38 is moved to and fro in a longitudinal manner by a third vice operating screw 80 journalled in the spacer block 40 and axially located with respect thereto by means of pins 82. The left hand end of the rod 80 in FIG. 2 is screw threaded and extends through a nut or slider 84 which is connected to the underside of the vice beam sections 38 by a single bolt (not shown). It is to be noted that the rod 80 also passes through the spacer block 50.

By rotation of the rod 80, by means of its handle 86, the nut 84 can be translationally moved in longitudinal direction and by virtue of the guidance provided by means of the bolts 54 in the slots 57 to 59 the vice beam section 38 can be shifted in a linear direction with respect to the stationary vice beam section 36.

The versatility of this bench is very considerable and can be appreciated particularly by reference to FIGS. 5 and 6. In FIG. 5 two workpieces 90 and 92 are shown clamped in a position where they are to be connected together in a manner of a T by means of dowels 94. It will be appreciated that the workpiece 90 is secured in the clamping gap between the clamping face of the movable rear vice beam 32 and the rearwardly facing clamping faces of the two section front beam 34. The second workpiece 92 is secured in a clamping gap between the opposed further clamping faces of the two sections 36 and 38 of the front beam 34.

FIG. 6 illustrates a workpiece 98 clamped by means of four plug-in abutments 72 two of them being located in bores in the rear vice beam 32 and one each in the vice beam sections 36 and 38. This again illustrates the composite clamping which can be obtained by use of the three vice operating screw thread devices.

Two modifications to the structure shown are envisaged. In the first the front vice member is in one piece and is stationary, whilst the rear vice member can be moved bodily by the two handles 22 and is formed in two parts which together form a longitudinally acting vice in exactly the same manner as the front vice member in the drawings.

In the second modification (applicable either to the embodiment in the drawings, or that described in the previous paragraph) the longer of the two sections of the longitudinally acting vice i.e., the section 38 is stationary and the shorter section 36 is movable.

The claims defining the invention are as follows:

I claim:

1. A portable workbench including a top structure and a supporting structure for supporting the top structure above the floor, the top structure including a first part, a second part and a third part, said parts having respective flat, top working surfaces in a common plane and conjointly defining a three part vice, the first part being a first elongate vice member and the second and third parts together forming a second elongate vice member extending in side-by-side relationship with the first elongate vice member, the two elongate vice members having opposed clamping faces, first vice operating means being included for causing movement of the clamping face of at least one vice member towards and away from the clamping face of the other vice member, the second and third parts defining respective further clamping faces mutually opposed and extending in a direction transverse to the opposed clamping faces of the first and second elongate vice members, and second vice operating means being included for causing relative movement of the second and third parts in a direction parallel to the direction of elongation of the vice members to permit clamping of objects between the opposed further clamping faces of the second and third parts, the respective top surfaces of the three parts conjointly defining a continuous uninterrupted smooth work surface when the elongate vice members are brought together so that their respective clamping surfaces are in mutual contact and when the second and third parts are also brought together so that the further clamping surfaces are also in mutual contact.

2. A workbench as claimed in claim 1 including a pair of transverse supports on which the first elongate member is supported for movement towards and away from the second vice member.

3. A workbench as claimed in claim 2 in which the top structure includes a front support extending between the front ends of the transverse supports and rigidly connected thereto, the front support at least partially carrying one or both of the second and third parts.

4. A workbench as claimed in claim 2 or claim 3 in which the first vice member is mounted for sliding movement on the transverse supports under the control of the first vice operating means.

5. A workbench including a top structure and a supporting structure for supporting the top structure above the floor, the top structure comprising a three part vice, one part comprising a first elongate vice member and the second and third parts together forming a second elongate vice member extending in side-by-side relationship with the first elongate vice member, the two elongate vice members having opposed clamping faces, first vice operating means being included for causing movement of the clamping face of at least one vice member towards and away from the clamping face of the other vice member, second vice operating means being included for causing relative movement of the second and third parts in a direction parallel to the direction of elongation of the vice members to permit clamping of objects between opposed further clamping faces of the second and third parts, a pair of transverse supports on which the first elongate member is supported for movement towards and away from the second vice member, the first vice member being mounted for sliding movement on the transverse supports under the control of the first vice operating means, and the first vice operating means including a pair of spaced vice operating screw threads each carrying a nut which is connected to the first vice member by a single vertical pivotal connection enabling independent operation of the two vice operating screws and the production of a tapered gap between first and second vice operating members.

6. A portable workbench as claimed in claim 2 in which the workbench includes a front support disposed between the transverse supports, the second part is rigidly fixed to one of the transverse supports and is supported partly by said one transverse support and partly by the front support.

7. A workbench as claimed in claim 6, in which the third vice part is mounted for sliding movement on the front support.

8. A workbench as claimed in claim 7, in which the third vice part is connected for sliding movement with respect to the front support by means of vertical bolts passing through the third vice part and through slots in the front support.

9. A workbench as claimed in claim 1 in which the three parts are separated from the remainder of the top structure by spacer blocks.

10. A workbench as claimed in claim 9 in which, in the case of the first vice member, the spacer blocks comprise one at each end and disposed between the first vice member and the transverse supports.

11. A workbench as claimed in claim 9 or claim 10 in which the second vice operating means extends through the spacer blocks separating the second vice part from the transverse support.

12. A workbench as claimed in claim 1 in which the second vice operating means extends below the second and third vice parts and includes a nut connected by a rigidvertical connection to the underside of the third part.

13. A workbench as claimed in claim 1 in which the first vice operating means is situated below the second vice operating means.

14. A workbench as claimed in claim 3 in which said transverse supports conjointly define a plane, the second vice operating means lies above the plane, whilst the first vice operating means comprises a pair of screw threaded rods each extending beneath said plane.

15. A portable workbench including a top structure and a folding supporting structure for supporting the top structure above the floor, the top structure including an elongate first vice member having a plurality of bores formed therein, a forwardly facing first planar clamping face on said first vice member, first vice operating means for positively shifting said first vice member from front to rear and vice versa, a short rigidly mounted second vice member having at least one bore formed therein transverse to the top surface thereof and having a second planar clamping face opposing a portion of said first planar clamping face of the first vice member and a third planar clamping face extending transversely to said second clamping face, a third movable vice member having at least one bore formed therein transverse to the top surface thereof and having a fourth clamping face positioned in the same plane as the second planar clamping face of the second vice member and a fifth planar clamping face facing the third clamping face, second vice operating means for positively shifting said fifth planar clamping face of the third vice member towards and away from the said third clamping face of the second vice member, and plug-in abutments located in selected ones of said bores in dependence upon the workpiece to be clamped therebetween.

16. The workbench of claim 15, said first, second and third vice members having respective flat, top working surfaces in a common plane, the respective top surfaces of the three vice members conjointly defining a continuous uninterrupted work surface when the first vice operating means is actuated to place the first planar clamping face in contact with the second and fourth planar clamping faces and when said second vice operating means is actuated to place the fifth planar clamping face in contact with the third planar clamping face.

* * * * *